US008082831B2

(12) United States Patent
Hiti

(10) Patent No.: US 8,082,831 B2
(45) Date of Patent: Dec. 27, 2011

(54) METHOD AND APPARATUS FOR AUTO-CENTERING AND CUTTING CHEESE LOAVES

(75) Inventor: Thomas R. Hiti, Plymouth, WI (US)

(73) Assignee: Sargento Foods, Inc., Plymouth, WI (US)

( * ) Notice: Subject to any disclaimer, the term of this patent is extended or adjusted under 35 U.S.C. 154(b) by 539 days.

(21) Appl. No.: 12/266,208

(22) Filed: Nov. 6, 2008

(65) Prior Publication Data

US 2009/0107311 A1 Apr. 30, 2009

Related U.S. Application Data

(63) Continuation-in-part of application No. 10/857,098, filed on May 28, 2004, now Pat. No. 7,592,029.

(51) Int. Cl.
*B26D 7/06* (2006.01)

(52) U.S. Cl. ..... 83/732; 83/420; 83/932

(58) Field of Classification Search ..... 83/732, 83/409, 409.1, 418, 420, 425, 435, 435.2, 83/436.3, 651.1, 932
See application file for complete search history.

(56) References Cited

U.S. PATENT DOCUMENTS

| | | | | |
|---|---|---|---|---|
| 707,528 | A | 8/1902 | Wolfinger | |
| 862,670 | A * | 8/1907 | Simpson | 83/167 |
| 1,943,587 | A | 1/1934 | Davis | |
| 1,993,621 | A | 3/1935 | Parsons | |
| 2,031,252 | A | 2/1936 | Criner | |
| 2,111,910 | A | 3/1938 | Fisher | |
| 3,255,717 | A | 6/1966 | Nervo | |
| 3,491,807 | A * | 1/1970 | Underwood | 83/105 |
| 3,492,132 | A | 1/1970 | Partyka | |
| 3,844,399 | A * | 10/1974 | Sellers et al. | 198/624 |
| 3,887,719 | A | 6/1975 | Miller | |
| 4,516,458 | A | 5/1985 | Pomerantz | |
| 4,599,928 | A | 7/1986 | Oker | |
| 4,626,436 | A | 12/1986 | Bradley et al. | |
| 4,681,000 | A | 7/1987 | Wolters | |
| 5,069,914 | A | 12/1991 | Gagliardi, Jr. | |
| 5,189,939 | A | 3/1993 | Allen, Jr. | |
| 5,320,575 | A * | 6/1994 | Fukamoto | 452/1 |
| 5,580,303 | A * | 12/1996 | Winslow et al. | 452/1 |
| 6,536,692 | B2 * | 3/2003 | Owens | 241/92 |
| 6,549,823 | B1 | 4/2003 | Hicks et al. | |
| 6,652,894 | B2 | 11/2003 | Fleetham | |
| 6,655,248 | B1 | 12/2003 | Johnson | |
| 6,748,837 | B2 * | 6/2004 | Benjamin et al. | 83/435.2 |
| 6,783,782 | B1 | 8/2004 | Larsen et al. | |
| D495,463 | S | 9/2004 | Childress | |
| 2001/0028912 | A1 | 10/2001 | Kaiser et al. | |
| 2002/0090427 | A1 | 7/2002 | Jordan | |
| 2002/0166429 | A1 | 11/2002 | Pryor et al. | |
| 2003/0017248 | A1 | 1/2003 | Gray | |
| 2004/0025651 | A1 | 2/2004 | Bachman et al. | |
| 2004/0151820 | A1 | 8/2004 | Harris | |
| 2004/0231526 | A1 | 11/2004 | Childress | |
| 2005/0170055 | A1 | 8/2005 | Gagliardi, Jr. | |
| 2006/0042434 | A1 | 3/2006 | Cumpton et al. | |
| 2007/0071877 | A1 | 3/2007 | Dear | |

* cited by examiner

*Primary Examiner* — Stephen Choi
(74) *Attorney, Agent, or Firm* — Reinhart Boerner Van Deuren s.c.

(57) ABSTRACT

An auto-centering apparatus and method of auto-centering and dividing a cheese loaf into equal cheese portions is disclosed wherein the cheese loaf is loaded on to a bottom conveyor that centers the cheese along the cutting harp centerline and equally divides the cheese loaf to provide substantially equally sized cheese portions.

19 Claims, 9 Drawing Sheets

METHOD AND APPARATUS FOR AUTO-CENTERING AND CUTTING CHEESE LOAVES

CROSS-REFERENCE TO RELATED APPLICATION

This application is a continuation-in-part of and claims priority to U.S. patent application Ser. No. 10/857,098 entitled "Method and Apparatus for Slicing Small Cheese Portions and Preparing Cheese Loaves for Slicing," which was filed on May 28, 2004 now U.S. Pat. No. 7,592,029, the entirety of which application is hereby incorporated herein by reference.

BACKGROUND OF THE INVENTION

Field of the Invention

The present invention relates generally to cheese products, and more particularly to automatically centering and dividing a cheese loaf or other foodstuff.

A cheese loaf is a large, substantially rectangular slab of cheese having standard height, width, and length dimensions. A large cheese loaf is typically divided into respective, aligned smaller loaves before being further processed, such as being cut into slices or cubes. The aligned smaller loaves are preferably substantially the same size, so that when the loaves reach the slicing or cutting operation, each of the resulting slices of cheese are substantially the same size.

However, difficulties can arise during when the larger loaf is divided into smaller loaves. For example, when the larger loaf is fed to the cutting machine, if the loaf is not properly aligned with the cutting blade, each of the resulting loaves will be a different cross sectional size, and so will the resulting cheese slices. Also, if not sufficiently held in the aligned position during the cutting operation, the loaf can shift during the cut, resulting in a jagged, unsmooth or diagonal cut. Further, splitting of the larger loaf may occur. The height and width of slices produced when a typical loaf is cut along a cross section correspond to the dimensions of the loaf.

SUMMARY OF THE INVENTION

The present invention offers a solution to the above-noted problems by providing an apparatus and method for auto-centering and cutting a cheese loaf into substantially equally-sized cheese portions. A loaf of cheese is typically a rectangular solid having a height dimension, a width dimension, a length dimension and a longitudinal centerline extending from the front end to the rear end of the cheese loaf. The apparatus and methods of the present invention can preferably be used to divide the cheese loaf along its longitudinal centerline.

The auto-centering apparatus includes a product input end onto which a cheese loaf is loaded and a discharge end where evenly cut cheese loaf portions are discharged from the apparatus for further processing. The apparatus includes a table-like support preferably including legs having bottom casters, so that the apparatus may be moved from one production line to another.

The auto-centering apparatus generally includes a conveyor system for horizontally moving an entering cheese loaf, an auto-centering positioning system and a cutting harp. More particularly, the conveyor system of the apparatus of the present invention includes a bottom conveyor secured to the top of a table support for moving the cheese loaf in a horizontal direction from the infeed end to the discharge end of the apparatus during incising. A floating top conveyor is also included and is adjustably mounted to the table support so that its belt is spaced apart from the bottom conveyor. The top conveyor comprises a vertically adjusting support system that permits the vertical height of the top conveyor belt to vary with respect to the vertically-fixed bottom conveyor belt and is configured to provide sufficient downward pressure on the cheese loaf to drive and guide it through the cutting harp.

The auto-centering positioning system in the apparatus of the present invention preferably comprises three centering sections or zones that are positioned along the length of the apparatus, before the cutting harp. Each of the centering sections are constructed in substantially the same manner, with each zone differing with respect to each other preferably only in the overall length and/or number of rollers included within the centering sections. One centering zone or more than three centering zones can also be used with good effect.

Each centering section is configured to straddle opposite sides of the apparatus, and is configured to move or adjust the position of an incoming cheese loaf to the centerline of the apparatus so that it may be cut down its centerline, providing two equally divided cheese loaf portions.

Each centering section generally includes first and second roller positioning mechanisms and a plurality of spaced apart and substantially aligned rollers located on opposite sides of the apparatus. Each roller positioning mechanism included within each centering section includes an air actuated cylinder or other actuatable device comprising a vertically positionable shaft and a connector plate. A first linkage member pivotally connects the actuatable device to a first positioning arm. Likewise, a second linkage member pivotally connects the actuatable device to a second positioning arm.

The arms are formed in substantially the same shape and are arranged in a mirror image or symmetrical fashion. Each arm includes an angled portion and an upwardly extending portion terminating in a top end. The first arm is arranged so that the upwardly extending portion is on one side of the conveyor system of the apparatus and the second arm is arranged so that the upwardly extending portion is on the opposite side of the conveyor system of the apparatus.

The arms of each positioning mechanism are pivotally secured together at a pivot point, which is substantially aligned with the centerline of the apparatus, in a scissors-like fashion.

Each centering section or zone includes a first set of positionable rollers secured via a bracket to the top ends of the first arms of each positioning mechanism, located on one side of the conveyor system. A second set of positionable rollers is secured via a second bracket to the top ends of the second arms of each positioning mechanism on the other, opposite side of the conveyor system.

The positioning mechanisms of each centering section of the apparatus are configured to be symmetrical about the apparatus centerline. The distance between the rollers on each side of the conveyor system varies depending on the width dimension of the entering cheese loaf. However, because each set of rollers moves the same distance towards or away from the cheese loaf, the scissors-like interconnection of the arms ensures that the midpoint of the distance between the rollers is configured to be the same as the centerline of the apparatus. As such, although the distance between the sets of rollers varies to accommodate cheese loaves of different sizes, the cheese loaf will always be moved by the sets of rollers to align with the apparatus centerline, in order to properly position the cheese loaf for cutting in the cutting harp.

The cutting harp of the apparatus of the present invention includes a frame comprising upper and lower horizontal frame members, and a cutting device, such as a cutting wire removably secured to the upper and lower frame members. The cutting wire is preferably secured to the harp frame at substantially the centerline of the apparatus.

The apparatus may optionally also include a slide member and an enclosure positioned substantially beneath the cutting harp for collecting pieces of cut cheese that result from the cutting operation.

An off loading roller conveyor can also be included to engage and/or catch the divided cheese loaves as they are pushed through the cutting harp. The roller conveyor can then be used to transport the divided cheese loaves to downstream processing equipment.

The methods of the present invention includes providing a cheese loaf at the product input end of the auto-centering apparatus. The loaf may be positioned at an angle, or may be otherwise unevenly positioned on the belt of the bottom conveyor.

As it is carried through the apparatus 40, the first centering section functions centers the cheese loaf so that the centerline of the cheese loaf is aligned with the cutting wire. In particular, the shaft of the cylinders in each of the positioning mechanisms is moved or actuated in a downward direction, causing the linkages to also be drawn in a downward direction. In turn, the lower ends of each of the arms are brought together in a scissors-like fashion.

As such, the arms on each of the positioning mechanisms pivot about the pivot point, causing the rollers positioned on opposite sides of the conveyor system to move inwardly and into contact with the edges of the cheese loaf. Because of the symmetrical nature of each of the centering sections, each set of rollers moves the same distance inward toward the centerline of the apparatus, regardless of the position of the incoming cheese loaf and centers the cheese loaf there along. It will be appreciated that the arms in each centering section and thus, the sets of rollers secured thereto, simultaneously move the same distance toward the centerline of the apparatus when the cylinder is actuated.

In this centered position, the centerline of the cheese loaf is substantially positioned along the centerline of the apparatus, and thus, the loaf is centered with respect to the cutting wire of the cutting harp. Like the first centering section or zone of the present invention, the second and third centering sections or zones function in a like manner to center the loaf along the centerline of the apparatus and maintain the loaf in the centered position as it is moved through the cutting harp.

Further during operation of the apparatus of the present invention, the top conveyor is adjusted to accommodate the height of the cheese loaf, so that the belt contacts the top surface thereof and maintains sufficient pressure on the cheese loaf to drive and guide it through the cutting harp.

It will be appreciated that the auto-centering and cutting apparatus and methods of the present invention can be used to automatically center a cheese loaf before any type of cutting or incising system, and is not limited only to dividing the loaves in half. Indeed, it will be readily appreciated that once centered within the apparatus, the cheese loaf can be divided or sliced in any number of sizes and portions.

The apparatus used to produce the cheese slices of the present invention is of a construction which is both dependable and durable, and it will also produce consistent product with little or no adjustment or maintenance required throughout its operating lifetime. The smaller size cheese slices of the present invention are also of manufacturing cost comparable to conventional cheese slices to enhance their market appeal and to thereby afford them the broadest possible market. Finally, all of the aforesaid advantages and objectives of the smaller cheese slices of the present invention are achieved without incurring any substantial relative disadvantage.

DESCRIPTION OF THE DRAWINGS

These and other advantages of the present invention are best understood with reference to the drawings, in which.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENT

An auto-centering food cutting apparatus, indicated generally at 40 is illustrated in its simplest form in FIGS. 1 through 13. Although the disclosure hereof is detailed and exact to enable those skilled in the art to practice the invention, the physical embodiments herein disclosed merely exemplify the invention which may be embodied in other specific structures. While the preferred embodiment is described herein, the details may be changed without departing from the invention, which is defined by the claims.

Figure 2:
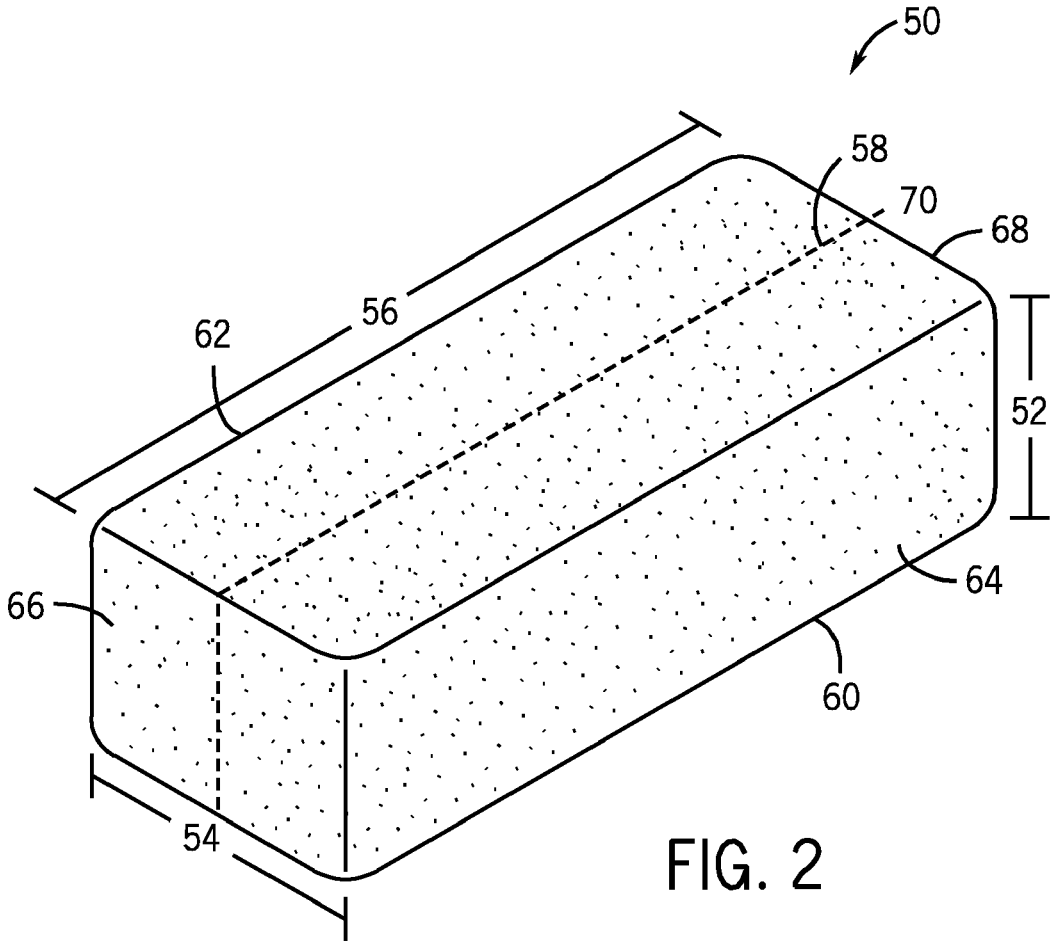
FIG. 2 is a perspective view of a typical rectangular cheese loaf to be used with the present invention.

Referring to the drawings, wherein like numerals represent like elements throughout the figures, a loaf of cheese is designated by the reference numeral 50, as illustrated in FIG. 2. The cheese loaf 50 may be formed from any known natural cheese or process cheese product, including, by way of example, cheddar, provolone, Swiss, or the like. Further, the auto-centering apparatus 40 may be used to center other foodstuffs presented in a loaf or of form, as will be well known to those skilled in the art.

As may be seen particularly in FIG. 2, the cheese loaf 50 is a rectangular solid having a height dimension 52, a width dimension 54 and a length dimension 56. The loaf 50 has top and bottom surfaces 58 and 60, opposing side surfaces 62 and 64 and front and rear ends 66 and 68. The cheese loaf 50 has a longitudinal centerline, indicated at 70 between the side surfaces 62 and 64. According to the teachings of the present invention, the cheese loaf 50 will be sliced along the centerline 70 so that the resulting smaller cheese loaf portions are substantially the same size. It will be understood that the apparatus and methods of the present invention can be used with cheese loaves of other cross-sectional shapes, such as square, circular, round and/or oblong cheese loaf configurations.

Figure 1:
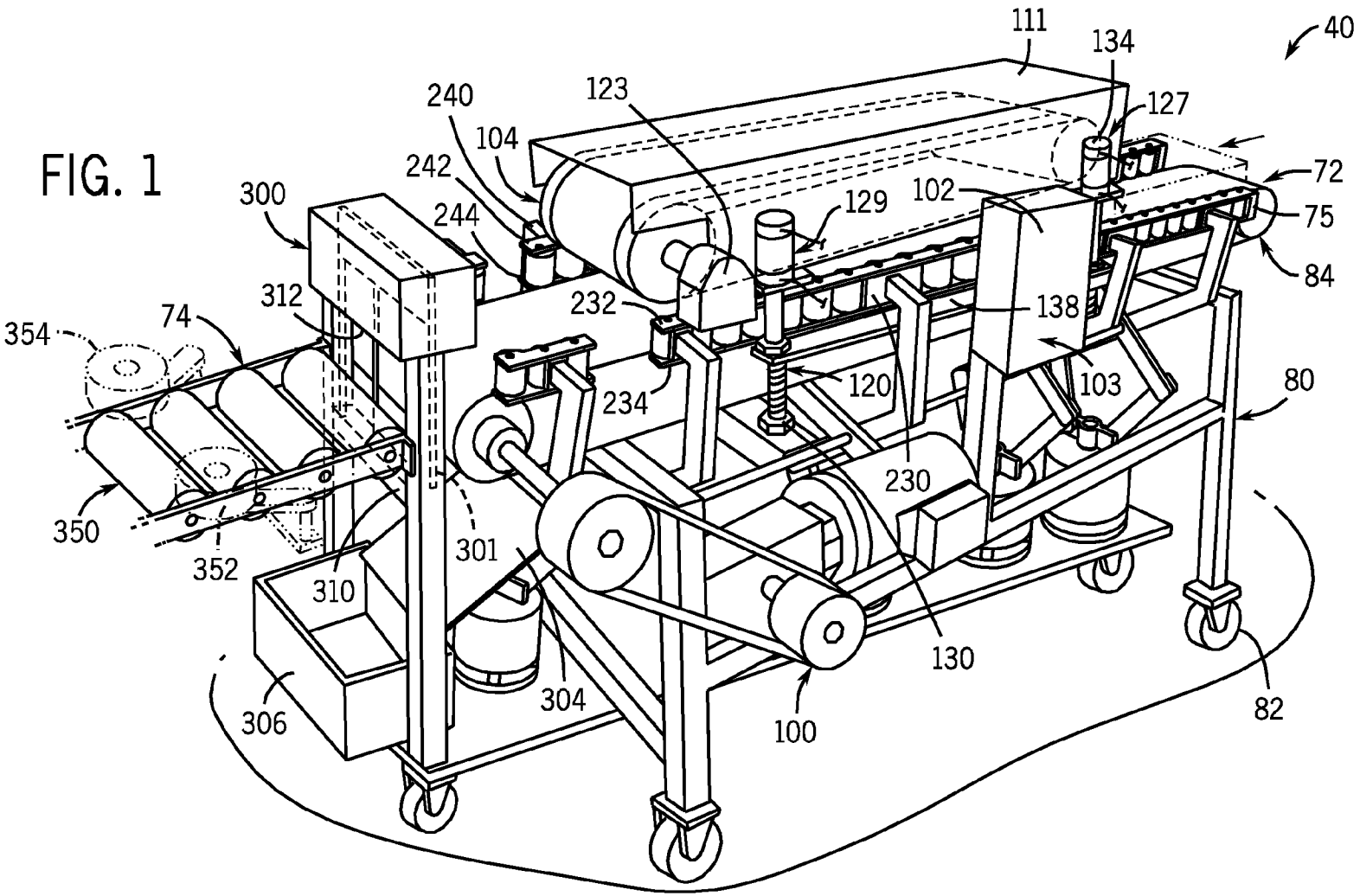
FIG. 1 is a perspective view of an exemplary embodiment of an auto-centering food cutting apparatus of the present invention.
Figure 3:
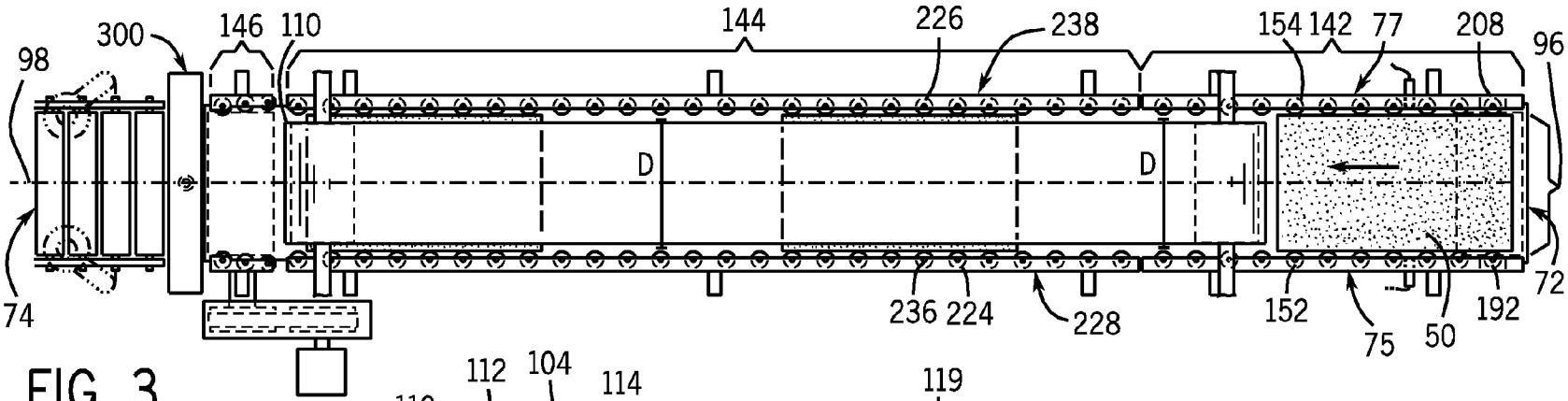
FIG. 3 is a top plan view of the auto-centering food cutting apparatus illustrated in FIG. 1.
Figure 4:
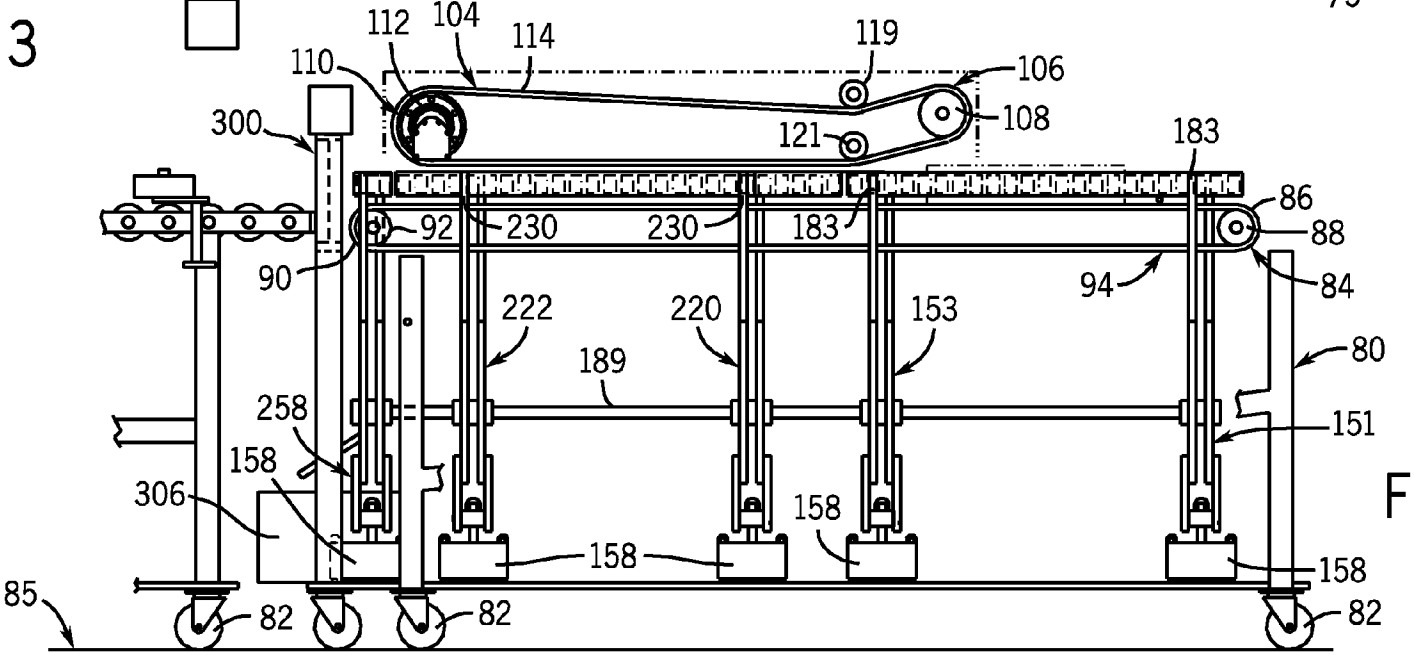
FIG. 4 is a side plan view of the auto-centering food cutting apparatus illustrated in FIGS. 1 and 3.

Referring to now FIGS. 1, 3 and 4, the apparatus 40 includes a product input or infeed end, indicated generally at 72, where a cheese loaf 50 is loaded on to the apparatus, and a product off-loading or discharge end, indicated generally at 74, where evenly cut cheese loaf portions 400 and 402 are discharged from the apparatus 40 for further processing. The apparatus 40 further includes opposing sides indicated at 75 and 77. The apparatus 40 includes a stationary, table-like support, indicated generally at 80, which preferably includes wheels or casters 82 so that the apparatus 40 can be easily rolled along the production floor 85 and moved between different production lines, if desired. The table support 80 is preferably constructed of a stainless steel or another food safe, cleanable material.

A bottom conveyor 84 is secured to the top of the support 80 for moving the cheese loaf 50 from the infeed end 72 to the discharge end 74 of the apparatus 40 during incising. The bottom conveyor 84 has a front end 86 including laterally spaced pulleys 88 and a rear end 90 also including laterally spaced pulleys 92. A continuous belt 94 extends around the pulleys 88 on the front end 86 and around the pulleys 92 on the rear end 90 of the conveyor 84. The conveyor belt, indicated generally at 94, has a width dimension 96 and a centerline 98 that extends along the entire length of the apparatus 40. The belt 94 is preferably constructed of a solid urethane material for sanitation and proper friction characteristics. However, other food safe materials known to those skilled in the art can also be used with good effect.

As illustrated in FIG. 1, the bottom conveyor 84 also preferably includes a variable speed drive system 100 and a control system 102 housed in an enclosure 103 mounted to the apparatus 40 for controlling the speed of the cheese loaf 50 as it moves through the apparatus. Consistent with the broader aspects of the present invention, the conveyor 84 can be any type conventional belt conveyor known to those skilled in the art suitable for use in food applications.

A floating top conveyor 104 is adjustably mounted to the support 80 in a spaced apart manner from the bottom conveyor 84. The top conveyor 104 has a front end 106 including laterally spaced pulleys 108 and a rear end 110 including laterally spaced pulleys 112. The rear pulleys 112 may be the drive pulleys of the conveyor 104, as will be well known to those skilled in the art. Additional sets of laterally spaced pulleys or rollers, indicated at 119 and 121, respectively, can be provided so that the front end 106 of the conveyor 104 is sloped in a slightly raised or upwards direction, to readily accept cheese loaves of varying heights, as will be described in more detail below.

Figure 7:
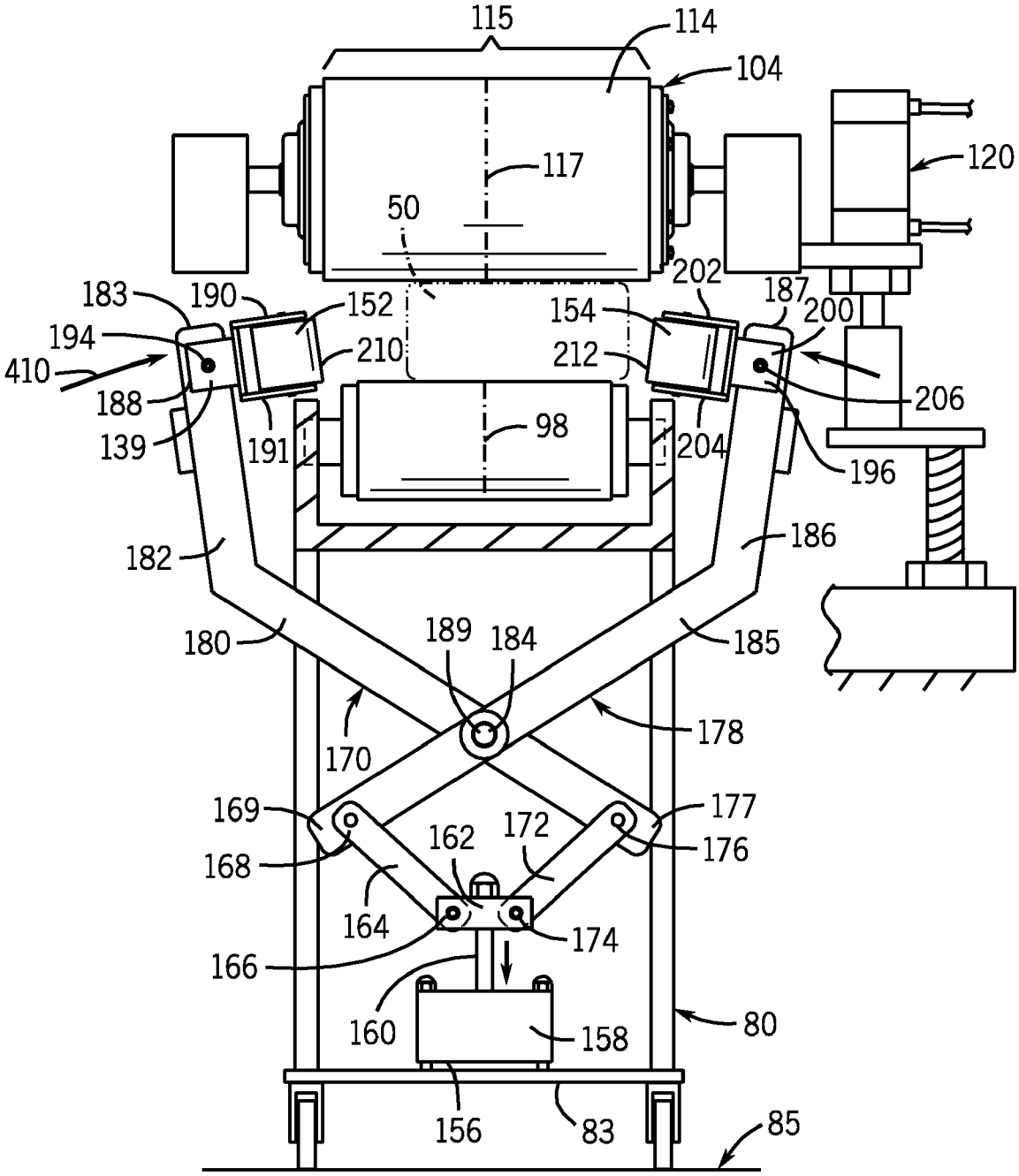
FIG. 7 is a cross section of the auto-centering food cutting apparatus shown in FIG. 5 which is taken along the line 7-7.
Figure 8:
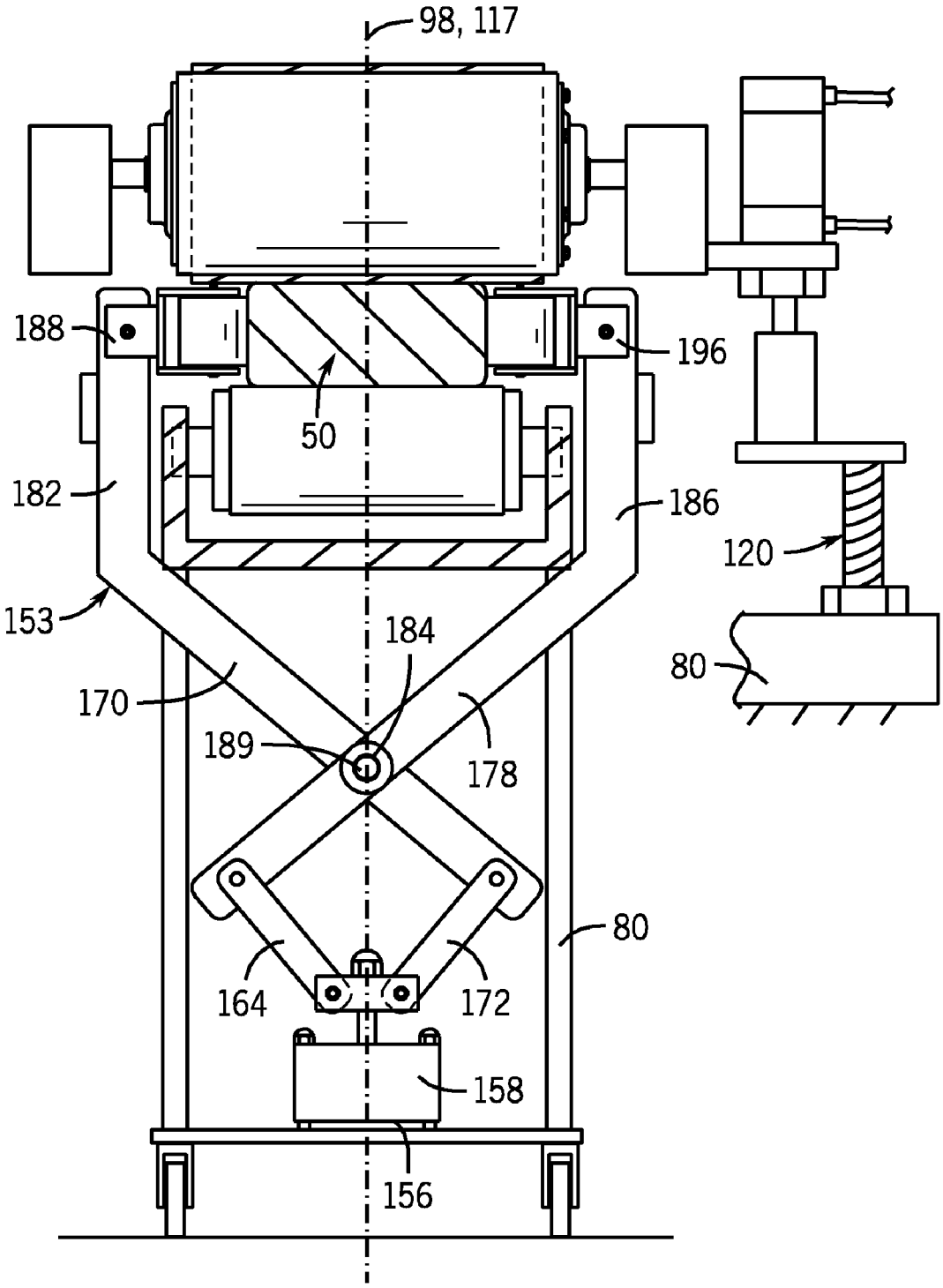
FIG. 8 is a cross section of the auto-centering food cutting apparatus shown in FIG. 6 which is taken along the line 8-8.

A continuous belt 114 extends around the pulleys 108 on the front end 106 and around the pulleys 112 on the rear end 110 of the conveyor 104. As best indicated in FIG. 7, the conveyor belt 114 has a width dimension 115 and a centerline 117. It will be appreciated that although the width 115 of the belt 114 of the top conveyor 104 is shown as slightly larger in size than the width 96 of the belt 94 of the bottom conveyor 84, the widths 96 and 115, respectively, can be substantially the same size. It will further be appreciated that the centerlines 98 and 117 of each of the continuous belts 94 and 114, respectively, are positioned in substantially the same location within the apparatus 40, as illustrated in FIGS. 7 and 8. Like the belt 94, the belt 114 is preferably constructed of a solid urethane material for sanitation and proper friction characteristics. However, other food safe materials known to those skilled in the art can also be used with good effect.

The top conveyor 104 preferably includes a cover or enclosure 111 to protect the belt 114 and shield moving parts of the apparatus 40 from users.

It will be appreciated that the top conveyor 104 also includes a variable drive system, indicated generally at 123, configured to operate in conjunction with and/or cooperatively with the variable drive system 100 of the bottom conveyor 84 to help move the cheese loaf 50 through the apparatus 40. As such, the control system 102 of the bottom conveyor 84 can be used to operate the top conveyor 104 and, as such, controls for both conveyor systems can be housed in the enclosure 103, as will be well known to those in the art.

Figure 12:
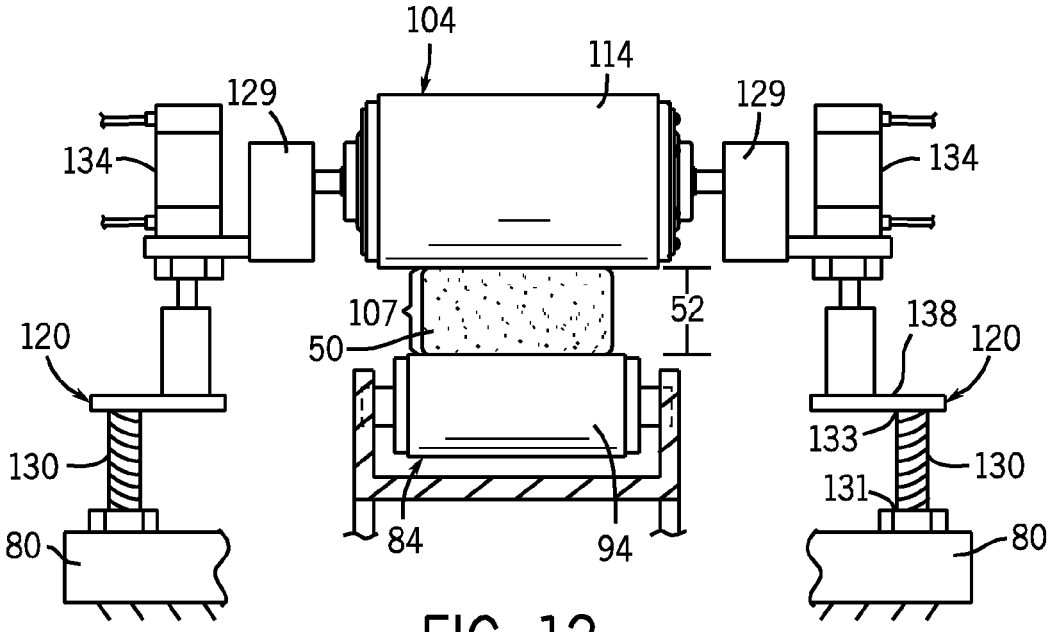
FIG. 12 is a fragmentary front end view of the auto-centering food cutting apparatus illustrated in FIGS. 1, 3 through 5, showing a cheese loaf of a first height within the apparatus.
Figure 13:
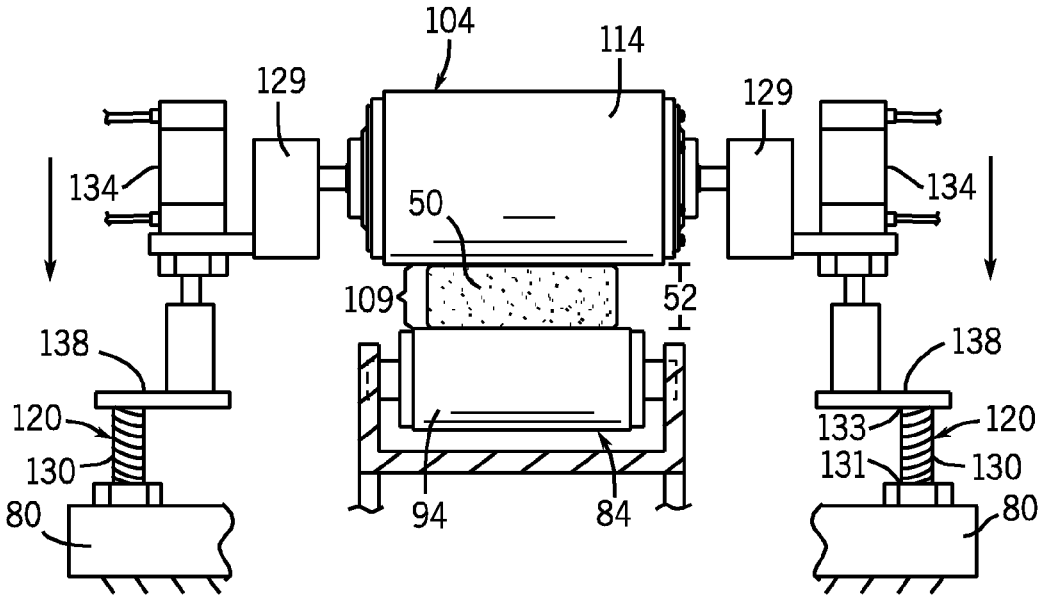
FIG. 13 is a fragmentary front end view of the auto-centering food cutting apparatus illustrated in FIGS. 1, 3 through 5, showing a cheese loaf of a second height within the apparatus.

Turning next to FIGS. 12 and 13, in addition to FIGS. 1 and 8, the top conveyor 104 includes a vertically adjusting support system, indicated generally at 120, that permits the vertical height of the belt 114 of the top conveyor 104 to vary with respect to the vertically fixed bottom conveyor belt 94. The vertically adjusting support system 120 movably secures the top conveyor 104 to the support 80 of the apparatus 40 on each of the sides 75 and 77 thereof, as illustrated in FIGS. 12 and 13.

Adjustability of the top conveyor 104 is provided to so that the apparatus 40 can be used to center cheese loaves 50 of different vertical heights. In particular, the top conveyor can move from one vertical position, indicated at 107 in FIG. 12, to another lower vertical position, indicated at 109 in FIG. 13, depending on the height dimension of the entering cheese loaf 50. It will be appreciated that the vertically adjusting support system 120 is configured to float/adjust to many different vertical heights, depending on the actual height dimension 52 of the entering cheese loaf 50.

The vertically adjusting support system 120 preferably includes a pair of level adjusters 127 located substantially near the front end 106 of the top conveyor 104, disposed on both the side 75 and the side 77 of the apparatus 40. A pair of level adjusters 129 are located substantially near the rear end 110 of the top conveyor 104, with the level adjusters positioned on opposite sides 75 and 77 of the apparatus 40. Each of the level adjusters 127 and 129 includes a threaded rod adjustment mechanism, indicated at 130, having an end 131 secured to the support 80 and an opposite end 133 in communication with an air actuated cylinder, indicated at 134. Other biasing mechanisms, such as spring devices, can be used with good effect to raise and lower the top conveyor as required by a given end use application.

A connector bar 138 secures each of the level adjusters 127 and 129 to each other on each side 75 and 77 of the apparatus 40, respectively, to maintain the top conveyor 104 at substantially the same vertical height or level across the entire length of the apparatus 40. The vertically adjusting support system 120 can be operated via a mechanism other than air actuated cylinders, such as utilizing fluid actuated, or linearly actuated systems, as is well known to those skilled in the art. It will be appreciated that the top conveyor 104 can include any type of vertical level adjusting mechanism that permits the system to accommodate and adjust to receive cheese loaves of different height dimensions.

When actuated, the vertically adjusting support system 120 regulates the height of the belt 114 of the top conveyor 104 to conform to the vertical height 52 of the entering cheese loaf 50, so that the belt 114 contacts the top surface 58 thereof and maintains sufficient pressure on the cheese loaf 50 to drive and guide it through the cutting harp 300. It will be appreciated that the pressure applied to the cheese loaf 50 is not great enough to damage or distort the cheese loaf 50 as it is fed through the cutting harp, as will be described in more detail below.

Turning next to FIGS. 5 through 11, in addition to FIGS. 1 through 4, the exemplary auto-centering and cutting apparatus 40 of the present invention preferably comprises three centering sections or zones, indicated generally at 142, 144 and 146, although more or less auto-centering zones may be provided depending of the type of application of the apparatus 40, the size of food item to be divided, manufacturing floor space, etc. As will be appreciated from the following description, each of the centering sections 142, 144 and 146 are constructed in substantially the same manner, with each zone differing with respect to each other preferably only in the overall length and/or number of rollers included within the centering sections.

As will be appreciated from the description that follows, each centering section 142, 144 and 146 is configured to straddle the sides 75 and 77 of the apparatus 40, and are configured to move or adjust the position of an incoming cheese loaf 50 to the centerline 98 of the apparatus 40 so that it may be cut down its centerline 70, providing two equally divided cheese loaf portions.

Figure 5:
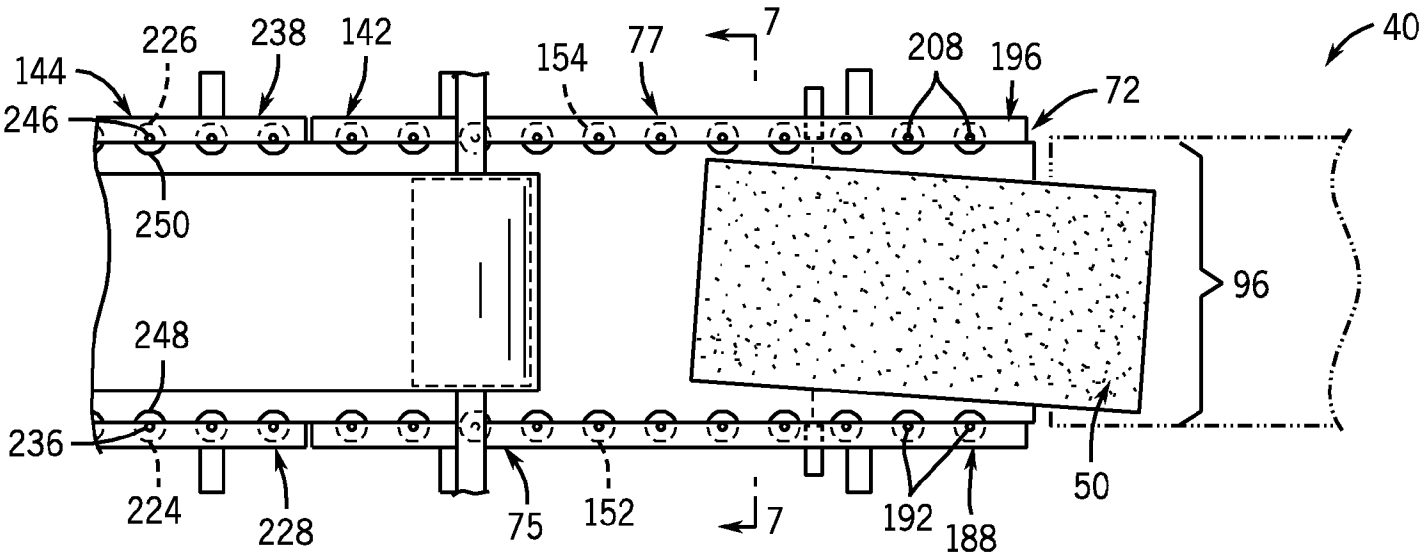
FIG. 5 is a fragmentary top view of the auto-centering food cutting apparatus illustrated in FIGS. 1, 3 and 4, showing an off center cheese loaf being loaded onto the apparatus.
Figure 6:
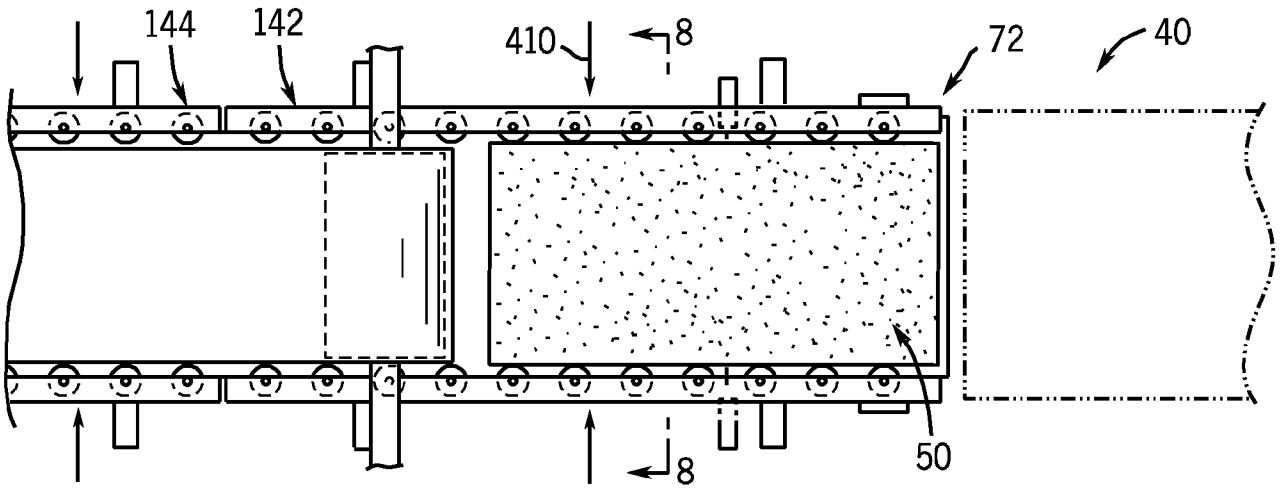
FIG. 6 is a fragmentary top view of the auto-centering food cutting apparatus illustrated in FIGS. 1, 3 through 5, showing adjustment of the cheese loaf by a first auto-centering section of the present invention.

The first centering section 142 generally includes first and second positioning mechanisms, indicated generally at 151 and 153 and a plurality of spaced apart and substantially aligned rollers 152 and 154 located on opposite sides of the apparatus 40, as indicated in FIGS. 5 and 6. As illustrated, one set of rollers 152 is located on the side 75 of the apparatus 40 and the other set of rollers 154 is located on the side 77 of the apparatus.

The positioning mechanisms 151 and 153 of the first centering section 142 are positioned in a spaced apart manner, as illustrated in FIG. 4. Each of the positioning mechanisms 151 and 153 are configured in a scissors-like manner, as illustrated by example in FIG. 7 and are constructed in a substantially identical manner, wherein like parts/components are designated by like reference numerals in the Figures. As such, it will be understood that the detailed construction of the positioning mechanism 151 of the first centering section 142 is as recited below, and is applicable and substantially identical to that of the positioning mechanism 153.

The positioning mechanism 151 includes a base member 156 mounted to the horizontally oriented planar member 83 of the support frame 80 and an air actuated cylinder or other actuatable device 158 coupled thereto. The actuator 158 has a vertically positionable shaft 160 and a connector plate 162. A linkage member 164 is pivotally attached at one end 166 to the connector plate 162 and is pivotally attached at the other end 168 thereof to a first or lower end 169 of a positioning arm 178. Likewise, a second linkage member 172 is pivotally attached at one end 174 to the connector plate 162 and is pivotally mounted at the other end 176 thereof to a first or lower end 177 of a second positioning arm 170.

The arms 170 and 178 are formed in substantially the same shape and are arranged in a mirror image or symmetrical fashion, as best illustrated in FIG. 7. The arm 170 preferably includes an angled portion 180 and an upwardly extending portion 182 terminating in a top end 183. Likewise, the arm 178 includes an angled portion 185 and an upwardly extending portion 186 terminating in a top end 187. The arm 170 is arranged so that the upwardly extending portion 182 is on side 75 of the apparatus 40 and the arm 178 is arranged so that the upwardly extending portion 186 is on the side 77 of the apparatus 40.

The arms 170 and 178 of the positioning mechanism 151 are pivotally secured together at a pivot point 184, which is substantially aligned with the centerline 98 of the apparatus 40. An elongated shaft 189 extends through the pivot point 184 and runs along the entire length of the apparatus 40. It will be appreciated that the upwardly extending portion 182 and 186 of each of the arms 170 and 178, respectively, is configured with respect to the angled portion 180 and 185 thereof such that the upwardly extending portions 182 and 186 can be positioned in a substantially vertical position, perpendicular to the floor 85, as illustrated in FIG. 8.

In addition to the positioning mechanisms 151 and 153, the first section 142 includes an elongated bracket 188 that is used to mount the rollers 152 on the side 75 of the apparatus 40. The bracket 188 is secured to the top edge 183 of the arm 170 of the positioning mechanism 151 and the top edge 183 of the arm 170 of the positioning mechanism 153, which are both located on the side 75 of the apparatus 40.

The bracket 188 comprises a mounting flange 139 and upper and lower spaced-apart plates 190 and 191. The bracket 188 is secured at opposite ends thereof to the top edges 183 of each of the arms 170 using a fastener 194, such as a bolt, screw or the like. Alternatively, the bracket 188 can be welded or otherwise secured to the arms 170. Each of the plurality of rollers 152 are rotatably mounted between the upper and lower plates 190 and 191 of the bracket 188 by a pin 192.

Likewise, the first section 142 includes an elongated bracket 196 that is used to mount the rollers 154 on the side 77 of the apparatus 40. The bracket 196 is secured to the top edge 187 of the arm 178 of the positioning mechanism 151 and the top edge 187 of the arm 178 of the positioning mechanism 153, which are located on the side 77 of the apparatus 40.

The bracket 196 comprises a mounting flange 200 and upper and lower spaced-apart plates 202 and 204. The bracket 196 is secured at opposite ends thereof to the top edge 187 of each of the arms 178, using a fastener 206, such as a bolt, screw or the like. Alternatively, the bracket 196 can be welded or otherwise secured to the arms 178 on the side 77 of the apparatus 40. Each of the plurality of rollers 154 are rotatably mounted between the upper and lower plates 202 and 204 of the bracket 196 by a pin 208.

Each of the plurality of rollers 152 and 154 of the first section 142 include an outer surface 210 and 212, respectively, that will contact the entering cheese loaf 50 during operation of the apparatus 40. As will be appreciated, the rollers 152 and 154 are constructed of a food safe material.

As illustrated in the FIGS. 7 and 8, in addition to FIGS. 1 through 6, the positioning mechanisms 151 and 153, and indeed, the first centering section 142 of the apparatus 40 are configured to be symmetrical about the apparatus centerline 98, as will be described in more detail herein. The distance D between the rollers 152 and 154 varies depending on the width 54 of the cheese loaf 50. However, it will be appreciated that the midpoint of the distance D between the rollers 152 and 154 is configured to be the same as the centerline 98 of the apparatus 40. As such, although the distance between the rollers 152 and 154 varies, the midpoint of the distance is the centerline 98, in order to properly position the cheese loaf for cutting in the cutting harp 300.

The second centering section or zone 144 generally includes first and second roller positioning mechanisms, indicated generally at 220 and 222 and a plurality of spaced apart and substantially aligned rollers 224 and 226 located on opposite sides of the apparatus 40, as indicated in FIGS. 3 through 6. As illustrated, one set of rollers 224 is located on the side 75 of the apparatus 40 and the other set of rollers 226 is located on the side 77 of the apparatus.

The positioning mechanisms 220 and 222 are positioned in a spaced apart manner, as illustrated in FIG. 4. The positioning mechanisms 220 and 222 are each configured in a substantially identical manner to the positioning mechanisms 151 and 153, wherein like parts/components are designated by like reference numerals in the Figures. As such, it will be understood that the detailed construction of the positioning mechanisms 220 and 222 of the second centering section 144 is as recited above with respect to the positioning mechanisms 151 and 153 of the first centering section 142, and is applicable thereto.

Accordingly, each of the positioning mechanisms 220 and 222 includes a base member 156 mounted to the horizontally oriented planar member 83 of the support frame 80 and an air actuated cylinder or other actuatable device 158 coupled thereto. The actuator 158 has a vertically positionable shaft 160 and a connector plate 162. A linkage member 164 is pivotally attached at one end 166 to the connector plate 162 and is pivotally attached at the other end 168 thereof to a lower end 169 of a positioning arm 178. Likewise, a second linkage member 172 is pivotally attached at one end 174 to the connector plate 162 and is pivotally mounted at the other end 176 thereof to a lower end 177 of a second positioning arm 170.

The arms 170 and 178 are formed in substantially the same shape and are arranged in a mirror image or symmetrical fashion within the apparatus 40, as best illustrated in FIG. 7. The arm 170 preferably includes an angled portion 180 and an upwardly extending portion 182 terminating in a top end 183. Likewise, the arm 178 includes an angled portion 185 and an upwardly extending portion 186 terminating in a top end 187.

The arms 170 and 178 of each of the positioning mechanisms 220 and 222 are pivotally secured together at a pivot point 184, which is configured to accommodate the elongated shaft 189 that extends through the pivot point 184 of the positioning mechanisms 151 and 153 and extends along substantially the entire length of the apparatus 40. It will be appreciated that the upwardly extending portion 182 and 186 of each of the arms 170 and 178, respectively, is configured with respect to the angled portion 180 and 185 thereof such that the upwardly extending portions 182 and 186 can be positioned in a substantially vertical position, perpendicular to the floor 85, as illustrated in FIG. 8.

In addition to the positioning mechanisms 220 and 222, the second centering section 144 includes an elongated bracket 228 that is used to mount the rollers 224 on the side 75 of the apparatus 40. The bracket 228 is secured to the top edge 183 of the arm 170 of the positioning mechanism 220 and the top edge 183 of the arm 170 of the positioning mechanism 222, which are both located on the side 75 of the apparatus 40.

The bracket 228 is constructed in a like manner to the brackets 188 and 196 and comprises a mounting flange 230 and upper and lower spaced-apart plates 232 and 234. The bracket 228 is secured at substantially opposite ends thereof to the top edges 183 of each of the arms 170 using a fastener (not shown) such as a bolt, screw or the like. Alternatively, the bracket 228 can be welded or otherwise secured to the arms 170 in any manner known to those skilled in the art. Each of the plurality of rollers 224 are rotatably mounted between the upper and lower plates 232 and 234 of the bracket 228 by a pin 236.

Likewise, the second centering section 144 includes an elongated bracket 238 that is used to mount the rollers 226 on the side 77 of the apparatus 40. The bracket 238 is secured to the top edge 187 of the arm 178 of the positioning mechanism 220 and the top edge 187 of the arm 178 of the positioning mechanism 222, which are located on the side 77 of the apparatus 40.

The bracket 238 comprises a mounting flange 240 and upper and lower, spaced-apart plates 242 and 244. The bracket 238 is secured at opposite ends thereof to the top edge 187 of each of the arms 178, using a fastener (not shown), such as a bolt, screw or the like. Alternatively, the bracket 238 can be welded or otherwise secured to the arms 178 on the side 77 of the apparatus 40. Each of the plurality of rollers 226 are rotatably mounted between the upper and lower plates 242 and 244 of the bracket 238 by a pin 246.

Each of the plurality of rollers 224 and 226 of the second centering section 144 includes an outer surface 248 and 250, respectively, that will contact the entering cheese loaf 50 during operation of the apparatus 40. As will be appreciated, the rollers 224 and 226 are constructed of a food safe material.

Like the first centering section, the positioning mechanisms 220 and 222 of the second centering section 144 are configured to be symmetrical about the apparatus centerline 98 to precisely center the cheese loaf. The distance D between the rollers 224 and 226 varies depending on the width 54 of the cheese loaf 50. However, it will be appreciated that the midpoint of the distance D between the rollers 224 and 226 is configured to be the same as the centerline 98 of the apparatus 40. As such, although the distance between the rollers 224 and 226 varies, the midpoint of the distance is the centerline 98, in order to properly position the cheese loaf for cutting in the cutting harp 300.

Figure 9:
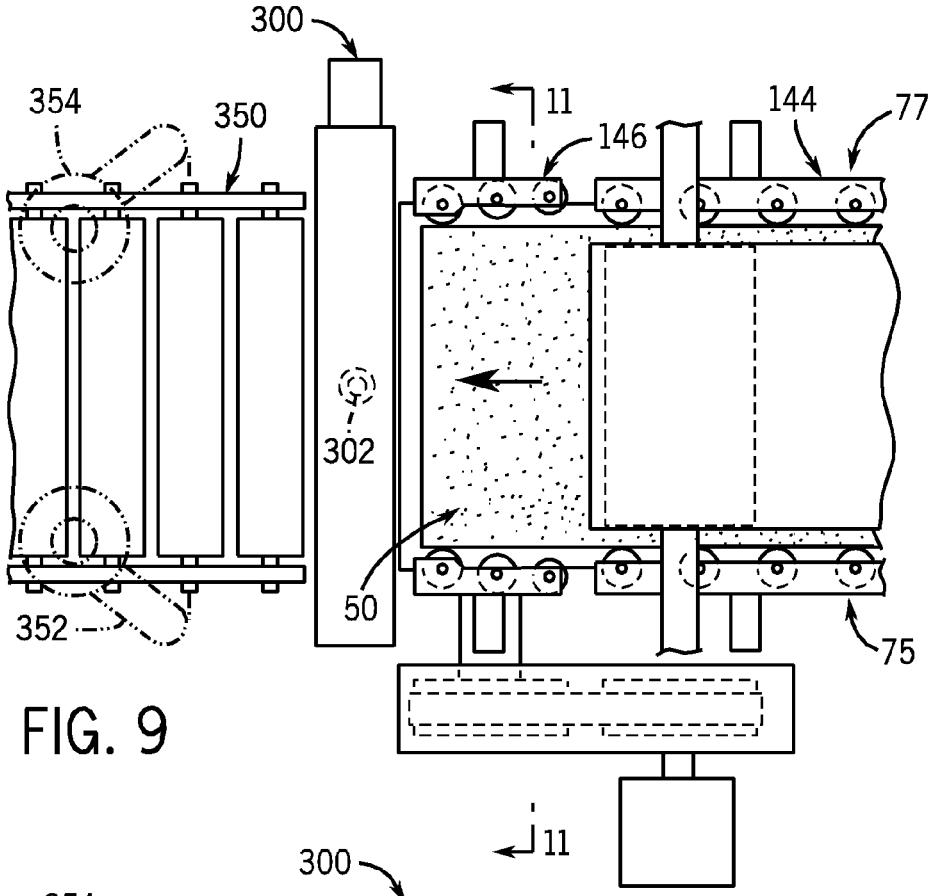
FIG. 9 is a fragmentary top view of the auto-centering food cutting apparatus illustrated in FIGS. 1, 3 and 4, showing the cheese loaf moving through the second and third auto-centering sections in accordance with the teachings of the present invention.
Figure 10:
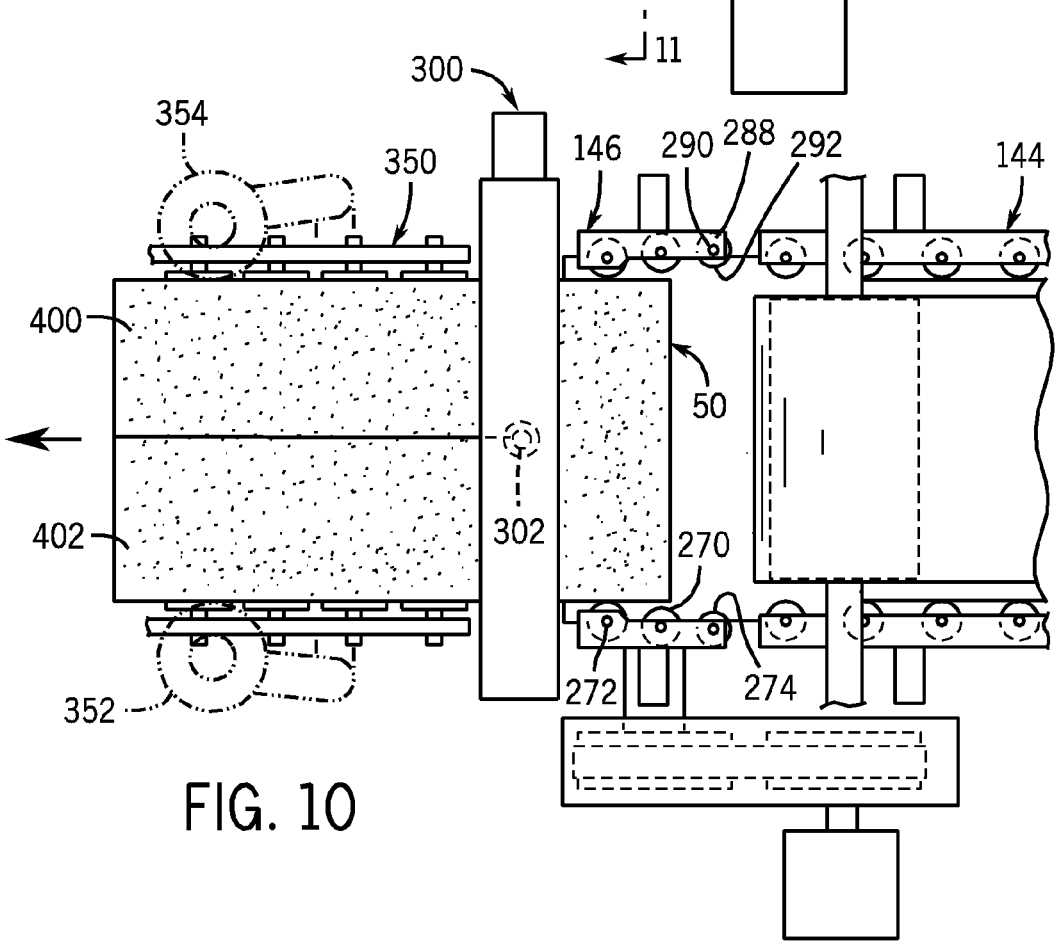
FIG. 10 is a fragmentary top view of the auto-centering food cutting apparatus illustrated in FIGS. 1, 3 through 5, showing the centered cheese loaf moving through a cutting harp and divided into two substantially equally sized portions.
Figure 11:
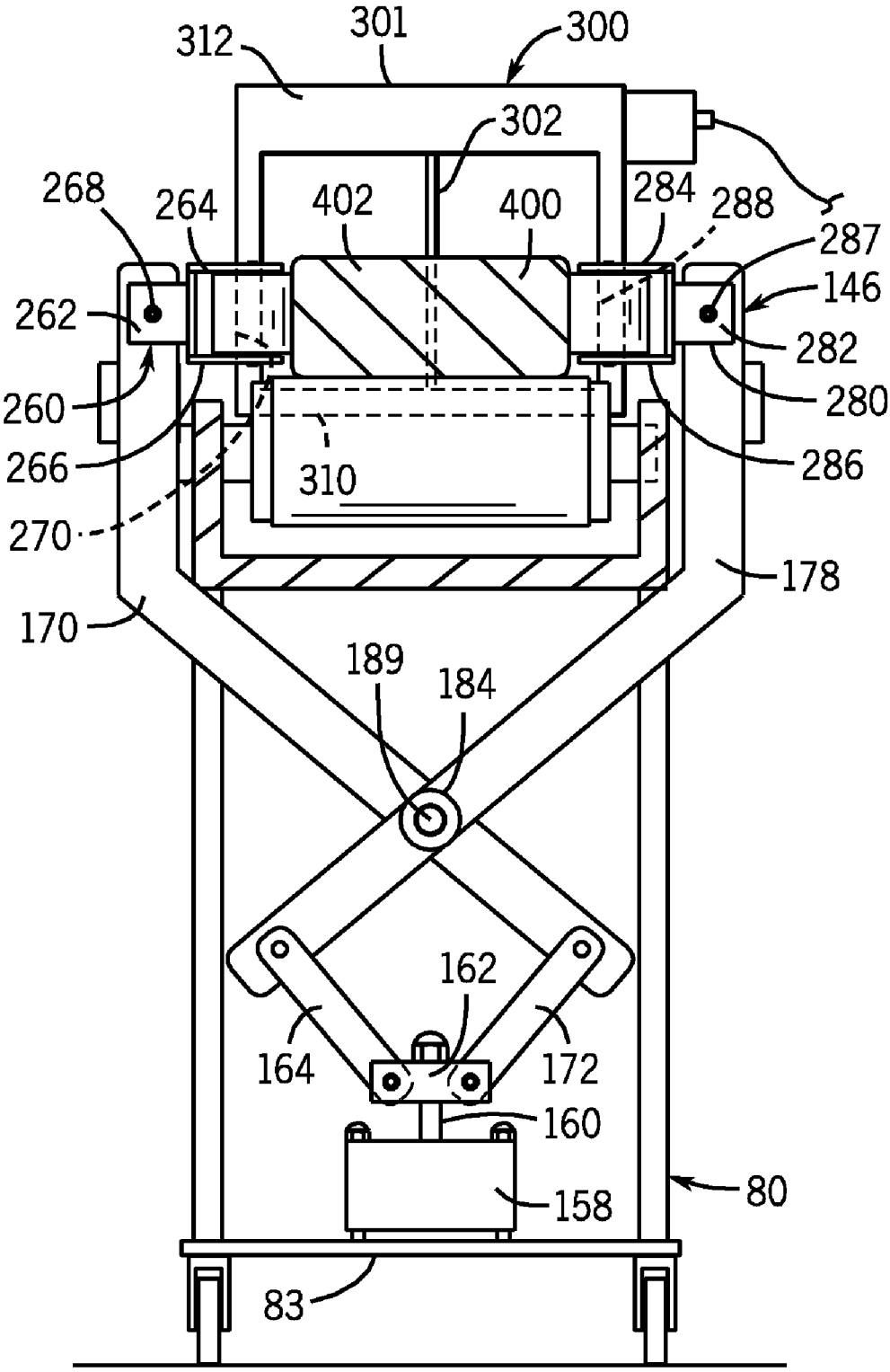
FIG. 11 is a cross section of the auto-centering food cutting apparatus shown in FIG. 9 which is taken along the line 11-11.

The third centering section or zone 146 generally includes a first roller positioning mechanism, indicated generally at 258 and a plurality of spaced apart and substantially aligned rollers 270 and 288 located on opposite sides of the apparatus 40, as indicated in FIGS. 9 through 11. As illustrated, one set of rollers 270 is located on the side 75 of the apparatus 40 and the other set of rollers 288 is located on the side 77 of the apparatus.

The positioning mechanism 258 is configured in a substantially identical manner to the positioning mechanisms 151, 153, 220 and 222, wherein like parts/components are designated by like reference numerals in the Figures. As such, it will be understood that the detailed construction of the positioning mechanism 258 of the third centering section 146 is as recited above with respect to the positioning mechanisms 151 and 153 of the first centering section 142, and is applicable thereto.

Accordingly, the positioning mechanism 258 includes a base member 156 mounted to the horizontally oriented planar member 83 of the support frame 80 and an air actuated cylinder or other actuatable device 158 coupled thereto. The actuator 158 has a vertically positionable shaft 160 and a connector plate 162. A linkage member 164 is pivotally attached at one end 166 to the connector plate 162 and is pivotally attached at the other end 168 thereof to a lower end 169 of a positioning arm 178. Likewise, a second linkage member 172 is pivotally attached at one end 174 to the connector plate 162 and is pivotally mounted at the other end 176 thereof to a lower end 177 of a second positioning arm 170.

The arms 170 and 178 are formed in substantially the same shape and are arranged in a mirror image or symmetrical fashion within the apparatus 40, as best illustrated in FIG. 7. The arm 170 preferably includes an angled portion 180 and an upwardly extending portion 182 terminating in a top end 183. Likewise, the arm 178 includes an angled portion 185 and an upwardly extending portion 186 terminating in a top end 187.

The arms 170 and 178 of each of the positioning mechanisms 220 and 222 are pivotally secured together at a pivot point 184, which is configured to accommodate the elongated shaft 189 that extends through the pivot point 184 of the positioning mechanisms 151 and 153 of the first centering section 142, and the positioning mechanisms 220 and 222 of the second centering section 144, which extends along substantially the entire length of the apparatus 40. It will be appreciated that the upwardly extending portion 182 and 186 of each of the arms 170 and 178, respectively, is configured with respect to the angled portion 180 and 185 thereof such that the upwardly extending portions 182 and 186 can be positioned in a substantially vertical position, perpendicular to the floor 85, as illustrated in FIG. 11.

In addition to the positioning mechanism 258, the third centering section 146 includes an elongated bracket 260 that is used to mount the rollers 270 on the side 75 of the apparatus 40. The bracket 260 is secured to the top edge 183 of the arm 170 of the positioning mechanism 258, which is located on the side 75 of the apparatus 40.

The bracket 260 is constructed in a like manner to the brackets 188 and 196 and comprises a mounting flange 262 and upper and lower spaced-apart plates 264 and 266. The bracket 260 is secured at substantially opposite ends thereof to the top edges 183 of each of the arms 170 using a fastener 268 such as a bolt, screw or the like. Alternatively, the bracket 260 can be welded or otherwise secured to the arm 170 in any manner known to those skilled in the art. Each of the plurality of rollers 270 are rotatably mounted between the upper and lower plates 264 and 266 of the bracket 260 by a pin 272.

Likewise, the third centering section 146 includes an elongated bracket 280 that is used to mount the rollers 288 on the side 77 of the apparatus 40. The bracket 280 is secured to the top edge 187 of the arm 178 of the positioning mechanism 258, which is located on the side 77 of the apparatus 40.

The bracket 280 comprises a mounting flange 282 and upper and lower spaced-apart plates 284 and 286. The bracket 280 is secured at opposite ends thereof to the top edge 187 of the arm 178, using a fastener 287, such as a bolt, screw or the like. Alternatively, the bracket 280 can be welded or otherwise secured to the arm 178 on the side 77 of the apparatus 40. Each of the plurality of rollers 288 are rotatably mounted between the upper and lower plates 284 and 286 of the bracket 280 by a pin 290.

Each of the plurality of rollers 270 and 288 of the third centering section 146 includes an outer surface 274 and 292, respectively, that will contact the entering cheese loaf 50 during operation of the apparatus 40. As will be appreciated, the rollers 270 and 288 are constructed of a food safe material.

Like the two previously described centering sections, the positioning mechanism 258 of the third centering section 146 is configured to be symmetrical about the apparatus centerline 98 to precisely center the cheese loaf. The distance D between the rollers 270 and 288 varies depending on the width 54 of the cheese loaf 50. However, it will be appreciated that the midpoint of the distance D between the rollers 270 and 288 is configured to be the same as the centerline 98 of the apparatus 40. As such, although the distance between the rollers 270 and 288 varies, the midpoint of the distance is the centerline 98, in order to properly position the cheese loaf for cutting in the cutting harp 300.

It will further be appreciated that each of the centering sections 142, 144 and 146 are preferably interconnected via the elongated shaft 189 and cooperatively controlled and operated, such that when the first centering section 142 operates to center the cheese loaf 50, the second and third centering sections correspondingly move to maintain the cheese loaf 50 in position. Alternatively, however, each of the centering sections 142, 144 and 146 can be individually controlled and operated independently from each other, which will be readily apparent and understood by one skilled in the art.

As best illustrated in FIGS. 1, 3, 4 and 11, a roller bed or roller conveyor 350 is mounted to the apparatus 40 and is secured close adjacent to, and spaced apart from the bottom conveyor 84. A cutting harp 300 is positioned between the third centering zone 146 and the cheese off-loading roller bed 350.

The cutting harp 300 includes a frame 301 comprising upper and lower horizontal frame members 312 and 310, respectively. A cutting device, such as a cutting wire 302 is removably secured to the upper and lower frame members 312 and 310 of the frame 301 of the cutting harp 300. It will be appreciated that the cutting wire 302 is secured to the harp frame 301 at substantially the centerline 98 of the apparatus 40, as indicated by reference numeral 98 (and 117) in the Figures, so that the cheese loaf 50 will be divided in substantially equal portions. It will be appreciated that the cutting wire 302 can be replaced with any type of cutting apparatus, such as a blade or knife, as will be well known to those skilled in the art. When required, the cutting wire 302 can be replaced or changed.

Consistent with the broader aspects of the present invention, the cutting harp 300 can be provided with more than one vertical cutting device or wire. In this way, a cheese loaf 50 can be divided into two or more equally sized pieces. In particular, the centering sections 142, 144 and 146 ensure that the cheese loaf 50 is provided to the cutting harp 300 in a centered position. As such, the cutting harp can include cutting wired to substantially evenly divide the cheese loaf in multiple, same-size pieces, as will be appreciated by those skilled in the art.

A slide member 304 and a collection pan 306 is secured to the support frame 80 of the apparatus 40 substantially beneath the cutting harp 300 for collecting pieces of cut cheese that result from the cutting operation.

The off loading roller conveyor 350 can include roller arms 352 and 354 that will engage the divided cheese loaves 400 and 402 as they are moved through the cutting harp 300. The roller conveyor 350 can be used to transport the divided cheese loaves 400 and 402 to downstream processing equipment.

Operation of the apparatus 40 will now be described with respect to FIGS. 1 through 13. As illustrated in FIG. 3, a cheese loaf 50 is loaded on to the bottom conveyor 84 at the product input end 72 of the apparatus 40. As the cheese loaf 50 is loaded on to the bottom conveyor 84, it will be appreciated that the loaf 50 may be positioned at an angle, or may be otherwise unevenly positioned on the belt 94 of the conveyor 84, as illustrated in FIGS. 5 and 7.

As it is carried through the apparatus 40, the first centering section 142 functions to center the cheese loaf 50. In particular, the shaft 160 of the cylinders 158 in each of the positioning mechanisms 151 and 153 is moved or actuated in a downward direction, as indicated in FIG. 7. Lowering of the shaft 160 causes the linkages 164 and 172 to be drawn in a downward direction, and in turn moves the lower ends 169 and 177 of each of the arms 178 and 170, respectively, together in a scissors-like fashion.

As such, the arms 170 and 178 on each of the positioning mechanisms 151 and 153 pivot about the pivot point 184, causing the rollers 152 and 154 to move inwardly and into contact with the edges 62 and 64 of the cheese loaf 50, as indicated by the arrows 410 in FIG. 7. Because of the symmetrical nature of the centering section 142, it will be appreciated that the rollers 152 and 154 will move the same distance inward toward the centerline 98 of the belt 94, regardless of the position of the incoming cheese loaf and will center the cheese loaf along the apparatus centerline 98.

For example, if the rollers 154 first contact the cheese loaf 50 on the side 77 of the apparatus 40, as indicated in FIG. 7, the centering section 142 will continue to center the cheese loaf 50 along the centerline 98 of the bottom conveyor 84, as indicated by the arrows 410 in FIG. 7. The arms 170 and 178 continue to move until both sets of rollers 152 and 154, located on opposite sides of the apparatus 40, contact the loaf 50, as indicated in FIGS. 6 and 8. It will be appreciated that the arms 170 and 178, and thus, the rollers 152 and 154 simultaneously move the same distance toward the centerline 98. As such, the rollers 154 can not overextend or otherwise urge the cheese loaf 50 to a position out of alignment with the centerline 98 of the bottom conveyor belt 94 because the rollers 152 move the same distance toward the centerline 98, and maintain the cheese loaf in the properly centered position.

In this centered position, the centerline 70 of the cheese loaf 50 is substantially positioned along the centerline 98 of the conveyor 84, and thus, the loaf 50 is centered with respect to the cutting wire 302 of the cutting harp 300.

As the cheese loaf 50 is moved towards the top conveyor 104, the top conveyor 104 is adjusted to accommodate the height of the cheese loaf. As recited above, the vertically adjusting support system 120 regulates the height of the belt 110 of the top conveyor 104 to conform to the vertical height 52 of the entering cheese loaf 50, so that the belt 110 contacts the top surface 58 thereof and maintains sufficient pressure on the cheese loaf 50 to drive and guide it through the cutting harp 300. It will be appreciated that the pressure applied to the cheese loaf 50 is not great enough to damage or distort the cheese loaf 50 as it is fed through the cutting harp, as will be described in more detail below.

Like the first centering section or zone 142, the second and third centering sections or zones 144 and 146 also center the loaf 50 along the centerline 98 of the bottom conveyor belt 94 of the apparatus 40 and maintain the loaf 50 in the centered position so that the cheese loaf 50 can be properly divided at the cutting harp 300.

As it is carried through the apparatus 40, the second and third centering sections 144 and 146 maintain the cheese loaf 50 in centered position. In particular, the shaft 160 of each of the cylinders 158 in each of the positioning mechanisms 220 and 222 of the second centering section 144 is moved or actuated in a downward direction. Lowering of the shaft 160 causes the linkages 164 and 172 to be drawn in a downward direction, and in turn moves the lower ends 169 and 177 of each of the arms 178 and 170, respectively, together in a scissors-like fashion. As such, the arms 170 and 178 of each of the positioning mechanisms 220 and 222 pivot about the pivot point 184, causing the rollers 224 and 226 of the second centering section 144 to move into contact with the edges of the cheese loaf 50. Because of the symmetrical nature of the centering section 144, it will be appreciated that each of the arms 170 and 178 will move inward toward the centerline 98 of the belt 94 the same distance.

Likewise, prior to entering the cutting harp 300, the cheese loaf 50 is finally centered by the third centering section 146. In particular, the shaft 160 of the cylinders 158 of the positioning mechanism 258 of the third centering section 146 is moved or actuated in a downward direction. Lowering of the shaft 160 causes the linkages 164 and 172 to be drawn in a downward direction, and in turn moves the lower ends 169 and 177 of each of the arms 178 and 170, respectively, together in a scissors-like fashion. As such, the arms 170 and 178 of the positioning mechanism 258 pivot about the pivot point 184, causing the rollers 270 and 288 of the third centering section 146 to move into contact with the edges of the cheese loaf 50. Because of the symmetrical nature of the centering section 146, it will be appreciated that each of the arms 170 and 178 will travel inward toward the centerline 98 of the belt 94 and an equal distance D.

It will be appreciated that each of the centering sections 142, 144 and 146 are interconnected via the shaft 189 that runs through the pivot point 184 of each of the positioning mechanisms 151, 153, 220, 222 and 258, respectively. As such, each of the centering sections 142, 144 and 146 can be operated cooperatively such that each set of rollers in each section moves the same distance towards the centerline of the apparatus 40 and maintain the cheese loaf in this position along the entire length of the apparatus 40.

While held in this position, the top and bottom conveyors drive the cheese loaf 50 through the cutting harp 300, where the loaf is divided into two substantially equal portions 400 and 402. The cheese portions 400 and 402 are off loaded onto the roller bed 350, and can be easily moved to other processing stations within the plant.

It may therefore be appreciated from the above detailed description of the preferred embodiment of the present invention that it facilitates the production of the smaller cheese loaves of equal size, that can easily utilized in downstream cutting and cheese shaping processes. The evenly divided cheese loaves produced by the present invention may be manufactured on a large scale without experiencing the problems previously encountered in the production of smaller cheese loaves for processing. The apparatus of the present invention is of a construction which is both dependable and durable, and it will also produce consistent product with little or no adjustment or maintenance required throughout its operating lifetime.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. An apparatus for auto centering and dividing a cheese loaf having a height, a width defined by opposing side surfaces and a length, the apparatus comprising:

a support frame;

a bottom conveyor secured to the support frame having a continuous belt including first and second side edges and a vertical centerline positioned at the midpoint between the first and second side edges of the belt, the belt having an upper working surface configured to transport the cheese loaf from a front end to a back end thereof;

a first positioning mechanism secured to a bottom portion of the support frame and extending a portion of the length of the upper working surface of the bottom conveyor, the first positioning mechanism comprising first and second pivotally interconnected arms coupled to a single pneumatic cylinder and extending vertically in the same plane, the arms configured in a mirror image fashion and configured to straddle opposite side edges of the belt, wherein the arms pivot about a pivot point that is substantially vertically aligned with the centerline of the continuous belt, wherein upper portions of each of the interconnected arms are configured to engage the cheese loaf, wherein each arm moves simultaneously the same distance dimension toward the centerline and away from the centerline of the belt; and a cutting harp located close adjacent to the rear end of the bottom conveyor, the cutting harp including a vertical cutting wire positioned at the centerline of the belt.

2. The apparatus of claim 1, wherein the support frame is a table-like structure having legs including a plurality of casters secured thereto.

3. The apparatus of claim 1, wherein the first positioning mechanism comprises:

a first set of spaced apart and longitudinally aligned rollers secured to the first arm of the positioning mechanism and located on the first side edge of belt of the bottom conveyor; and a second set of spaced apart and longitudinally aligned rollers secured to the second arm of the positioning mechanism and located on the second side edge of belt of the bottom conveyor, wherein the first and second set of rollers are configured a distance away from each other, the midpoint of the distance being substantially the same location as the centerline of the belt, wherein the first and second rollers are configurable between a first position in which each set of rollers is spaced apart from the side surfaces of the cheese loaf and a second position in which each set of rollers contacts the side surfaces of the cheese loaf.

4. The apparatus of claim 1, wherein the first positioning mechanism further comprises third and fourth pivotally interconnected arms, spaced apart from the first and second interconnected arms, the third and fourth arms configured in a mirror image fashion and configured to straddle opposite side edges of the belt, wherein the third and fourth interconnected arms pivot about a pivot point that is substantially vertically aligned with the centerline of the continuous belt and substantially horizontally aligned with the pivot point of the first and second interconnected arms, wherein upper portions of each of third and fourth interconnected arms are configurable to move the same distance dimension toward the centerline and away from the centerline of the belt; and a first set of spaced apart and longitudinally aligned rollers secured to the upper portions of the first and third arms of the first positioning mechanism and located on the first side edge of belt of the bottom conveyor; and a second set of spaced apart and longitudinally aligned rollers secured to the upper portions of the second and fourth arms of the first positioning mechanism and located on the second side edge of belt of the bottom conveyor, wherein the first and second set of rollers are configured a distance away from each other, the midpoint of the distance being substantially the same location as the centerline of the belt, wherein the first and second rollers are configurable between a first position in which each set of rollers is spaced apart from the side surfaces of the cheese loaf and a second position in which each set of rollers contacts the side surfaces of the cheese loaf.

5. The apparatus of claim 1, further comprising a second positioning mechanism constructed in an identical manner to the first positioning mechanism and secured to the support frame close adjacent to the first positioning mechanism.

6. The apparatus of claim 1, further comprising:

a top conveyor secured to the support frame and vertically spaced apart from the bottom conveyor, the top conveyor including a continuous belt including first and second side edges and a vertical centerline at the same position as centerline of the bottom conveyor, the belt having lower working surface capable of engaging the cheese loaf;

a vertically height adjusting mechanism for varying the distance between the bottom conveyor and the top conveyor to accommodate cheese loaves having a plurality of different height dimensions.

7. The apparatus of claim 1, further comprising:

a roller bed positioned adjacent to an outlet of the cutting harp for receiving divided cheese loaf portions.

8. An apparatus for auto centering a cheese loaf having side surfaces and an upper surface, the apparatus comprising:

a horizontally disposed support frame;

a bottom conveyor system secured to the frame, the bottom conveyor system having a length dimension, a width dimension defined by opposing sides and a vertical centerline between the opposing sides;

a top conveyor having a length dimension secured to the frame and having a substantially horizontal belt that is vertically adjustable with respect to the bottom conveyor system;

at least one centering section secured to the frame and including a least one set of pivotally interconnected arms coupled to a single pneumatic cylinder, each arm including an upper end, a middle section and a lower end extending vertically in the same plane, wherein the middle sections of each of the arms in the at least one set of arms are pivotally secured to each other at a pivot point that is vertically aligned with the centerline of the bottom conveyor system, wherein the upper end of one arm is located on one side of the bottom conveyor system and the upper end of the other arm of the set of pivotally interconnected arms is located on the opposing, other side of the bottom conveyor system with each set of arms configured to move simultaneously;

a first set of spaced apart and longitudinally aligned rollers secured to the upper portion of one of the arms of the at least one centering section;

a second set of spaced apart and longitudinally aligned rollers secured to the upper portion of the other arm of the set of pivotally interconnected arms, wherein the first and second set of rollers are configured a distance away from each other, the midpoint of the distance being substantially the same location as the centerline of the belt, wherein the first and second rollers are configurable between a first position in which each set of rollers is spaced apart from the side surfaces of the cheese loaf and a second position in which each set of rollers contacts the side surfaces of the cheese loaf; and a cutting harp including at least one cutting wire secured to the frame at a rear end of the bottom conveyor system.

9. The apparatus of claim 8, wherein the support frame is a table-like structure having legs including a plurality of casters secured thereto.

10. The apparatus of claim 8, wherein the bottom conveyor further comprises a control system for moving a cheese loaf from a front end to a rear end thereof.

11. The apparatus of claim 10, wherein the top conveyor further comprises a control system for moving a cheese loaf from a front end to a rear end thereof, wherein the control system cooperatively controls movement of the cheese loaf with the control system of the bottom conveyor.

12. The apparatus of claim 8, wherein the distance between the bottom conveyor and the top conveyor is varied using a biasing mechanism and an actuatable device to move the top conveyor from a position spaced apart from the cheese loaf to a position in contact with an upper surface of a cheese loaf.

13. The apparatus of claim 8, wherein the cutting harp includes a vertical cutting wire positioned at the centerline of the bottom conveyor system.

14. The apparatus of claim 8, further comprising:

a roller bed positioned adjacent to an outlet of the cutting harp for receiving divided cheese loaf portions.

15. The apparatus of claim 8, further comprising a cover protecting an upper portion of the top conveyor.

16. An auto-centering and cutting apparatus for use with a cheese loaf having side surfaces, the apparatus comprising:

a horizontally disposed support frame;

a bottom conveyor system secured to the frame and having an upwardly disposed working surface including a front end, a rear end, a length therebetween, and a vertical centerline disposed at the midpoint between first and second opposing sides of the working surface;

a top conveyor system secured to the frame and having an downwardly disposed working surface that is space apart from and vertically adjustable with respect to the upper working surface of the bottom conveyor system;

a first set of roller side rails including a first roller side rail positioned on the first side of the working surface of the bottom conveyor system and a second roller side rail positioned on the second side of the working surface of the bottom conveyor system, the first and second roller side rails each having a bottom portion that is pivotally interconnected at a pivot point that is substantially vertically aligned with the vertical centerline of the bottom conveyor system and coupled to a single pneumatic cylinder, wherein the bottom portion of each of the first and second roller side rails is aligned vertically in the same plane, and wherein each bottom portion move simultaneously the same distance, wherein the first set of roller side rails extends from the front end of the bottom conveyor to a distance along the length of the bottom conveyor and wherein the first and second roller side rails are configurable between a first position in which each of the first and second roller side rails is spaced apart from the side surfaces of the cheese loaf and a second position in which each set of rollers contacts the side surfaces of the cheese loaf; and a cutting harp including at least one vertical cutting wire removably secured to the frame at a position close adjacent to the rear end of the bottom conveyor system.

17. The apparatus of claim 16, wherein each of the first and second roller side rails of the first set of roller side rails comprises a plurality of interconnected and longitudinally aligned rollers mounted to a bracket.

18. The apparatus of claim 16, further comprising a second set of roller side rails including a first roller side rail positioned on the first side of the working surface of the bottom conveyor system and a second roller side rail positioned on the second side of the working surface of the bottom conveyor system, the first and second roller side rails each having a bottom portion that is pivotally interconnected at a pivot point that is substantially vertically aligned with the vertical centerline of the bottom conveyor system, wherein the second set of roller side rails extends from a position close adjacent to the first set of side roller rails to a second distance along the length of the bottom conveyor and wherein the first and second roller side rails of the second set of roller side rails are configurable between a first position in which each of the first and second roller side rails is spaced apart from the side surfaces of the cheese loaf and a second position in which each set of rollers contacts the side surfaces of the cheese loaf.

19. The apparatus of claim 18, further comprising a third set of roller side rails including a first roller side rail positioned on the first side of the working surface of the bottom conveyor system and a second roller side rail positioned on the second side of the working surface of the bottom conveyor system, the first and second roller side rails each having a bottom portion that is pivotally interconnected at a pivot point that is substantially vertically aligned with the vertical centerline of the bottom conveyor system, wherein the third set of roller side rails extends from a position close adjacent to the second set of side roller rails to the rear end of the bottom conveyor and wherein the first and second roller side rails of the third set of roller side rails are configurable between a first position in which each of the first and second roller side rails is spaced apart from the side surfaces of the cheese loaf and a second position in which each set of rollers contacts the side surfaces of the cheese loaf.

* * * * *